US005957070A

United States Patent [19]

Yoshida et al.

[11] Patent Number: 5,957,070

[45] Date of Patent: Sep. 28, 1999

[54] PROGRAMMABLE ELECTRONIC SEWING MACHINE

[75] Inventors: Shinji Yoshida, Nagoya; Kazushi Inoue, Aichi-gun; Yoshihiro Hara, Kasugai; Minoru Yamaguchi, Kariya, all of Japan

[73] Assignee: Brother Kogyo Kabushiki Kaisha, Nagoya, Japan

[21] Appl. No.: 09/084,398

[22] Filed: May 27, 1998

[30] Foreign Application Priority Data

May 28, 1997 [JP] Japan ..... 9-138731

[51] Int. Cl.[6] ..... D05B 19/08; D05B 19/12

[52] U.S. Cl. ..... 112/470.04; 112/445; 364/470.09

[58] Field of Search ..... 112/470.04, 470.01, 112/470.06, 445, 457, 456, 458, 102.5; 364/470.09, 470.07

[56] References Cited

U.S. PATENT DOCUMENTS

| | | | |
|---|---|---|---|
| 4,870,916 | 10/1989 | Kozawa et al. | 112/445 X |
| 4,943,906 | 7/1990 | Tajima et al. . | |
| 5,427,044 | 6/1995 | Hirabayashi | 112/458 X |
| 5,657,708 | 8/1997 | Okuno et al. . | |
| 5,782,189 | 7/1998 | Hirata et al. | 112/470.04 X |

*Primary Examiner*—Peter Nerbun
*Attorney, Agent, or Firm*—Oliff & Berridge, PLC

[57] ABSTRACT

A programmable electronic sewing machine includes sewing means for executing a sewing operation according to a predetermined program, program composing means for composing the program, displaying means for displaying a plurality of icons representative of commands used in composition of the program respectively, and input means for entering data used in composition of the program and for selecting a desired one of the icons displayed by the displaying means.

20 Claims, 9 Drawing Sheets

PROGRAMMABLE ELECTRONIC SEWING MACHINE

BACKGROUND OF THE INVENTION

1. Field of the Invention

This invention relates to a programmable electronic sewing machine which executes a sewing operation on the basis of a predetermined program.

2. Description of the Related Art

Sewing machines of the pattern seamer type are known as the above-mentioned programmable electronic sewing machine. An operation panel of the sewing machine and an operation box or a programmer include various operation keys. The keys for entering numerals and characters are operated in a predetermined sequence so that a program used for the sewing operation is composed. For example, when a program used for sewing a circle on a workpiece cloth at a stitch pitch of 3 mm, the numeral "3" representative of the stitch pitch is entered, and a key, e.g., an "M" key is operated for designation of a special command. Arrow keys or JOG keys are then operated to designate the center and a circumferential point of the circle. Thereafter, a command to instruct clockwise sewing of the circle, for example, "999" is entered. Furthermore, an ENTER key is operated. A program is composed when a command for instructing execution of calculation, for example, "789" is entered and the ENTER key is then operated.

When the program is composed in the above-described operation sequence, the user needs to remember what meaning each of the commands, "M," "999" and "789" has. The user who does not remember these commands needs to refer to an command manual etc. in composing the program. Accordingly, the program composition in such an operation sequence as described above is a delicate and troublesome job.

SUMMARY OF THE INVENTION

Therefore, an object of the present invention is to provide a programmable electronic sewing machine wherein the program used for the sewing operation can readily be composed.

The present invention provides a programmable electronic sewing machine comprising sewing means for executing a sewing operation according to a predetermined sewing program, program composing means for composing the sewing program, displaying means for displaying variable display contents including a plurality of icons representative of commands used in composition of the sewing program respectively, and input means for entering data used in composition of the sewing program and for selecting a desired one of the icons displayed by the displaying means.

According to the above-described sewing machine, the displaying means displays the various commands used for composition of the sewing program in the form of the icons. Accordingly, a user, even if he or she is a beginner, can readily select the icon corresponding to a desired command. A desired sewing program can be composed when the input means is operated so that the icon corresponding to the desired command and data concerning composition of the sewing program are entered. Thus, even the beginner can readily compose a desired sewing program used for the sewing. Furthermore, since the icons are employed to display the commands, new icons can be added when new functions are added to the sewing machine. Thus, keys or other physical members need not be added.

In a preferred form, the displaying means displays, together with the icons, an operating manner of the input means allowed with respect to the displayed icons. In another preferred form, the sewing machine further comprises a portable operation panel connected to and disconnected from the sewing machine. In this case, the displaying means and the input means are preferably provided on the operation panel. In further another preferred form, the sewing machine further comprises an operation panel, and the displaying means and the input means are provided on the operation panel.

BRIEF DESCRIPTION OF THE DRAWINGS

Other objects, features and advantages of the present invention will become clear upon reviewing the following description of preferred embodiments thereof, made with reference to the accompanying drawings, in which.

DETAILED DESCRIPTION OF THE PREFERRED EMBODIMENT

Figure 1:
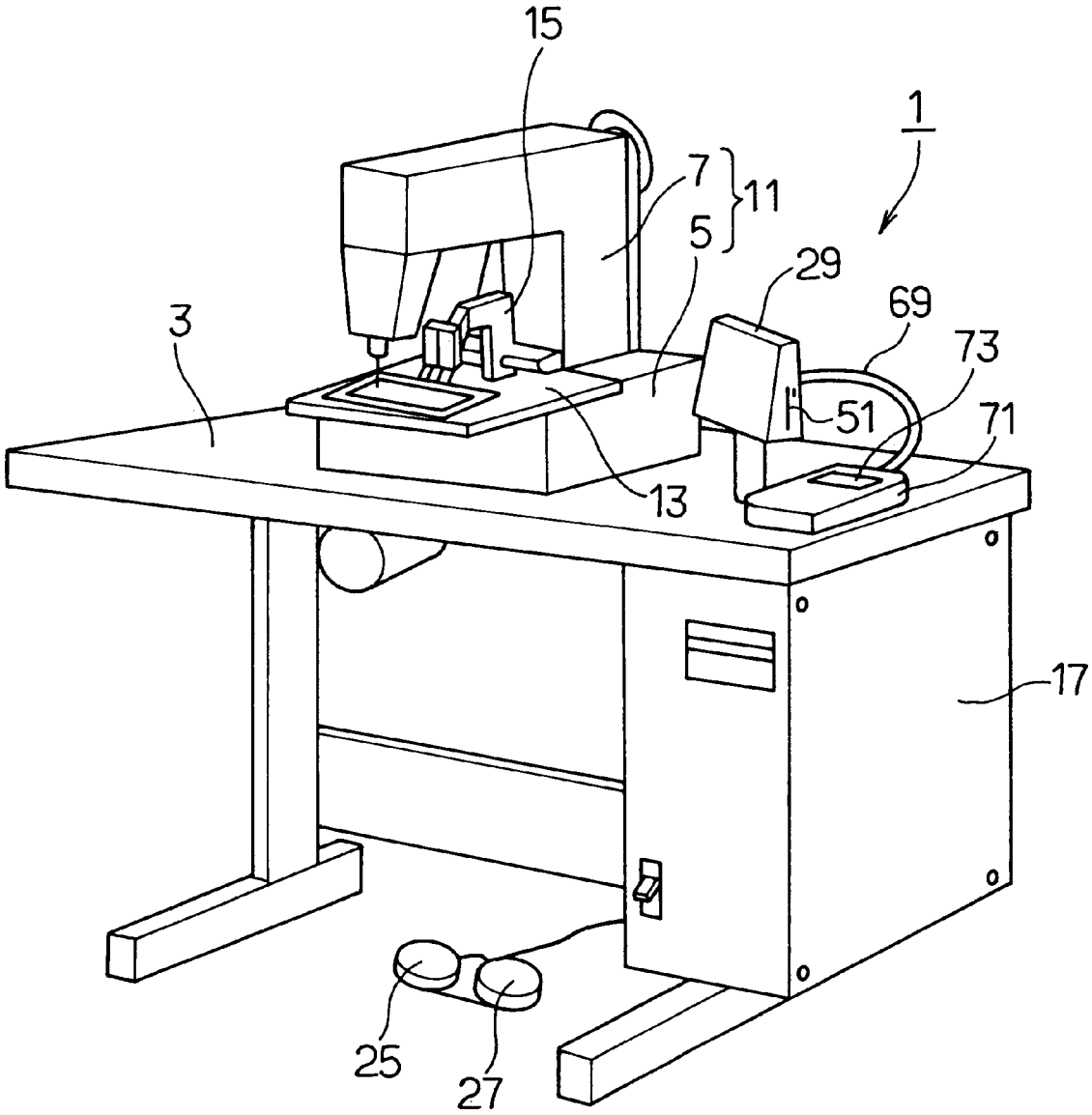
FIG. 1 is a perspective view of a programmable electronic sewing machine of one embodiment in accordance with the present invention.

One embodiment of the present invention will be described with reference to the drawings. Referring to FIG. 1, the programmable electronic sewing machine 1 of the embodiment is shown. The shown sewing machine 1 is an electronically controlled pattern sewing machine of the pattern seamer type executing a pattern sewing, for example, sewing a personal name or the like onto a workpiece cloth.

The sewing machine 1 includes a sewing table 3, a sewing bed 5 mounted on the sewing table 3, and an arm 7 extending vertically from the rear of the sewing bed 5 and then horizontally frontward, as shown in FIG. 1. The bed 5 and the arm 7 constitute a body 11 of the sewing machine 1. A needle plate 13 is fixed on the front upper face of the sewing bed 5. A cloth presser 15 is provided over the needle plate 13. The cloth presser 15 is moved in the X direction by an X-axis motor 21 (see FIG. 5) and in the Y direction by a Y-axis motor 23 (see FIG. 5). Each of the X-axis and Y-axis motors 21 and 23 comprises a stepping motor, for example, and is controlled by a sewing machine control device 17 provided on the right-hand end of the underside of the table 3. A presser switch 25 and a start switch 27 are connected to the control device 17. The presser switch 25 is operated so that a cloth presser plate 35 of the cloth presser 15 is moved upward and downward as will be described later. The start switch 27 is operated so that the sewing operation is started.

An operation panel 29 stands on the upper face of the sewing table 3 on the right of the body 11.

Figure 2:
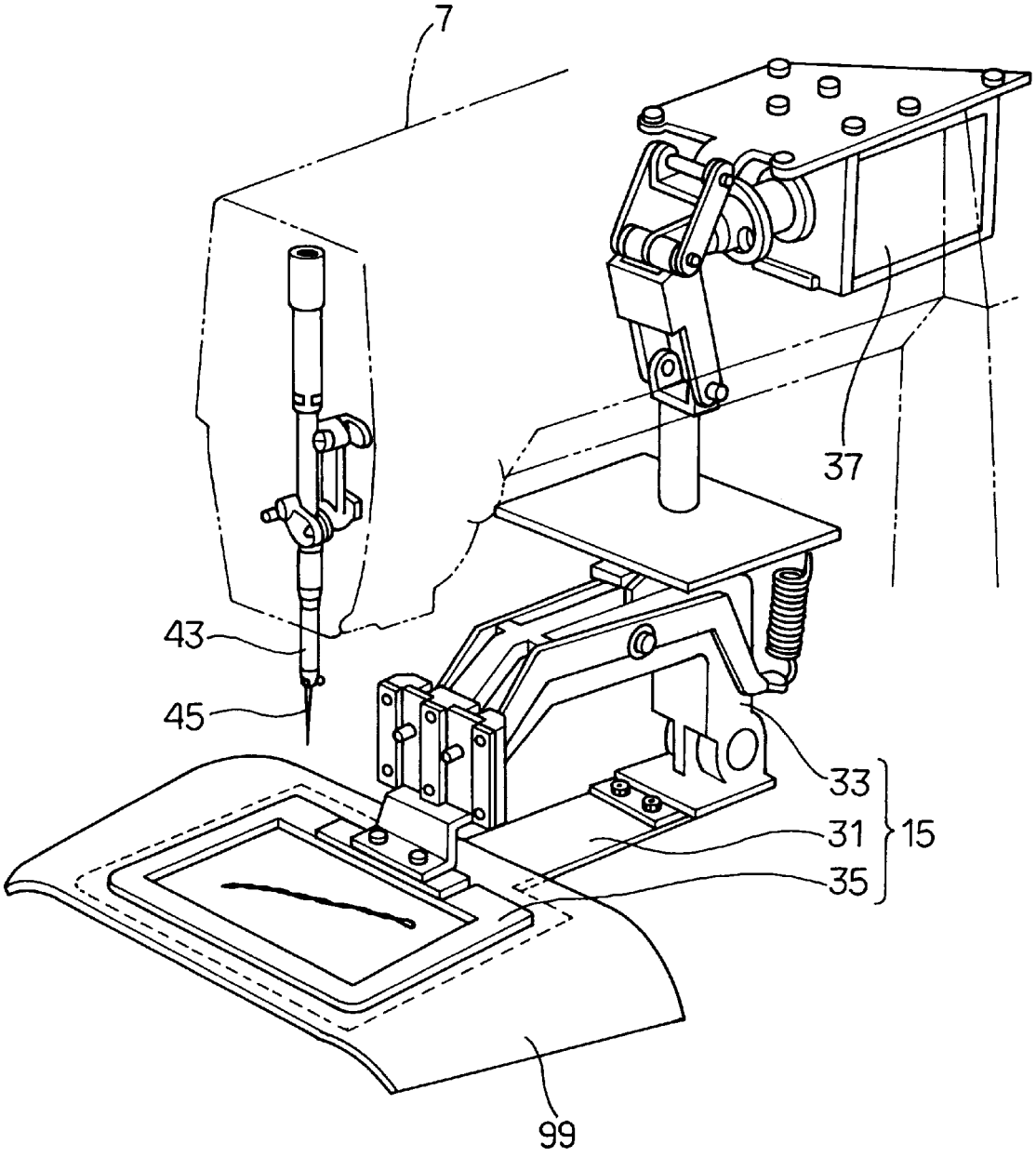
FIG. 2 is a perspective view of a cloth presser of the sewing machine.

Referring to FIG. 2, the cloth presser 15 includes a feed plate 31, a presser arm 33 and the cloth presser plate 35. The feed plate 31 is moved in the X and Y directions on the upper face of the needle plate 13 (see FIG. 1). The presser arm 33 is disposed on the right-hand end of the feed plate 31 as viewed in FIG. 2. The cloth presser plate 35 is disposed on the front end of the presser arm 33 for vertical movement. The cloth presser plate 35 is usually urged upward by a spring (not shown) so as to be away from the feed plate 31. Upon actuation of a presser solenoid 37 mounted on the arm 7, the cloth presser plate 35 is lowered onto the feed plate 31 against a spring force. As a result, a workpiece cloth 99 is held between the feed plate 31 and the cloth presser plate 35.

A needle bar 43 is mounted on the front end of the arm 7 so as to be moved vertically reciprocally. A sewing needle 45 is attached to a lower end of the needle bar 43. The needle bar 43 is driven by a needle bar driving mechanism (not shown) further driven by a sewing machine motor 41 (see FIG. 5). A shuttle (not shown) is rotatably mounted below the needle plate 13. The shuttle is driven by a shuttle driving mechanism (not shown) further driven by the motor 41. The cloth presser 15 is moved in the X and Y directions by the X-axis and Y-axis motors 21 and 23 while the needle bar 43 and accordingly the needle 45 are vertically moved and the shuttle is rotated by the motor 41, so that a pattern sewing is executed on the cloth 99.

Figure 3:
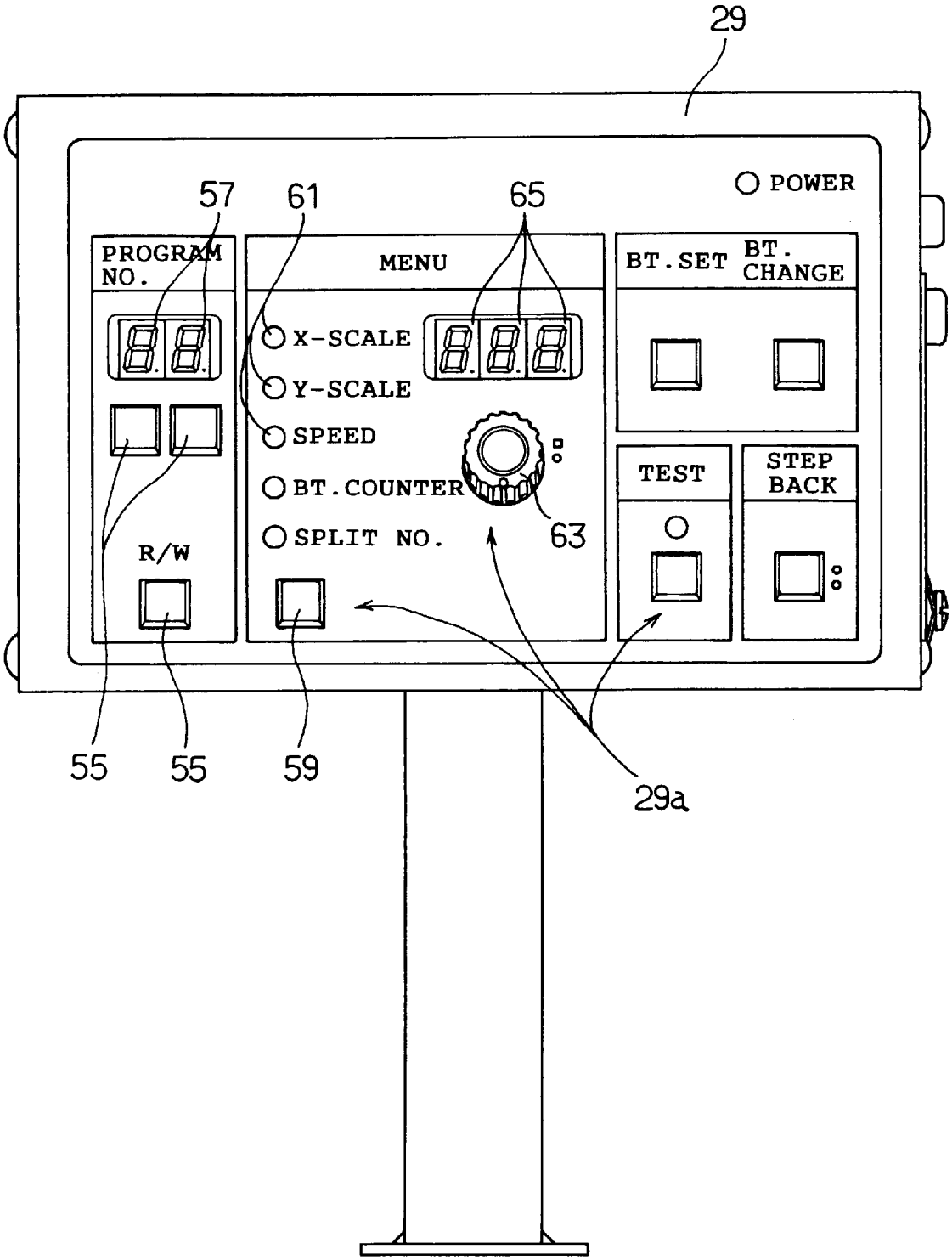
FIG. 3 is a front view of an operation panel of the sewing machine.

The operation panel 29 will now be described with reference to FIG. 3. The operation panel 29 comprises, on its front face, various operation switches 29*a* and displays including a read/write switch 53, a pair of program number selecting switches 55, a pair of 7-segment type displays 57, a menu selecting switch 59, five menu lamps 61, a dial 63, and three 7-segment type displays 65. A floppy disk drive 51 is provided in the right-hand side of the operation panel 29 as shown in FIG. 1. The read/write switch 53 is operated so that programs for the sewing are read and written via the floppy disk drive 51. The program number selecting switches 55 are operated so that a program number of the program to be read or written is selected. The 7-segment type displays 57 display the selected program number in. two digits. The menu selecting switch 59 is operated so that one of five items, "X-SCALE," "Y-SCALE," "SPEED," "BT. COUNTER," and "SPLIT NO." "BT." in "BT. COUNTER" refers to "bobbin thread." The menu lamps 61 are turned on when the respective items are selected. The dial 63 serves as operating means for changing numeric values set in connection with the respective items. The 7-segment type displays 65 display the numeric value set in connection with the selected item in three digits.

The 7-segment type displays 65 also display error numbers corresponding to the contents of errors. The first digit displays "E" indicative of occurrence of an error and the second and third digits display a two-digit number corresponding to the contents of the error. A connector (not shown) is provided on the left-hand side of the operation panel 29. A portable operation panel or a programmer 71 is disconnectably connected via a cable 69 to the connector, as shown in FIG. 1. The programmer 71 includes a liquid crystal display (LCD) 73 and various operation switches 71*a* (see FIG. 6) serving as input means. The LCD 73 is provided for displaying an icon for program composition, and the error contents and a recovery method in the form of sentence. The switches 71*a* include an ESC key 75 for canceling input and returning a screen of the LCD 73 one step, a HELP key 77 for displaying a predetermined help screen on the LCD 73, an ENTER key 79 for entering various data, CHARACTER keys 81 for entering data such as numeric values, and ARROW keys 83 for moving a cursor or jog.

Figure 5:
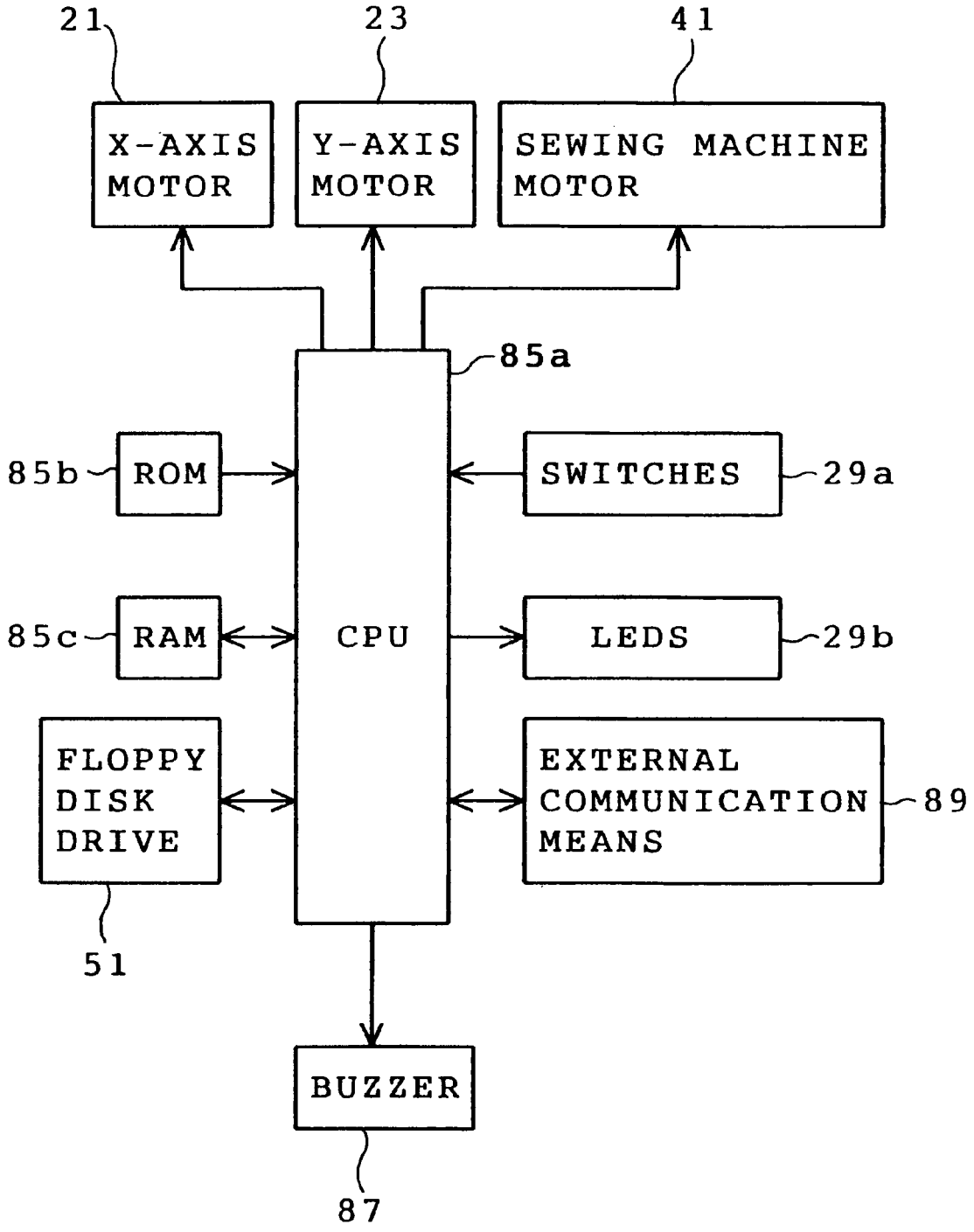
FIG. 5 is a block diagram of a control system of the sewing machine.

Control systems of the sewing machine 1 and the programmer 71 will now be described with reference to FIGS. 5 and 6. Well known arrangements such as drive circuits and interfaces are eliminated in FIGS. 5 and 6. Referring first to FIG. 5, an electrical arrangement of the control system of the sewing machine 1 is shown. A CPU 85*a* controls the overall operation of the sewing machine 1 and executes various control programs stored in a ROM 85*b*. The CPU 85*a* and the control programs constitute sewing means in the invention. A RAM 85*c* temporally stores various data during operation of the CPU 85*a* . The CPU 85*a* delivers drive signals to the X-axis and Y-axis motors 21 and 23 and the motor 41 to drive the motors. The CPU 85*a* is connected to the floppy disk drive 51 to read and write data from and into a floppy disk (not shown) installed in the floppy disk drive 51. The CPU 85*a* receives switch signals from the switches 29*a* of the operation panel 29 and delivers drive signals to the LEDs 29*b* (the 7-segment displays 57 and 65 and the menu lamps 61) to drive them. The CPU 85*a* further delivers a drive signal to the buzzer 87 so that the buzzer performs an alarming operation. The CPU 85*a* transmits and receives data to and from the programmer 71 via external communication means 93 comprising the above-mentioned connector and an interface circuit.

Figure 6:
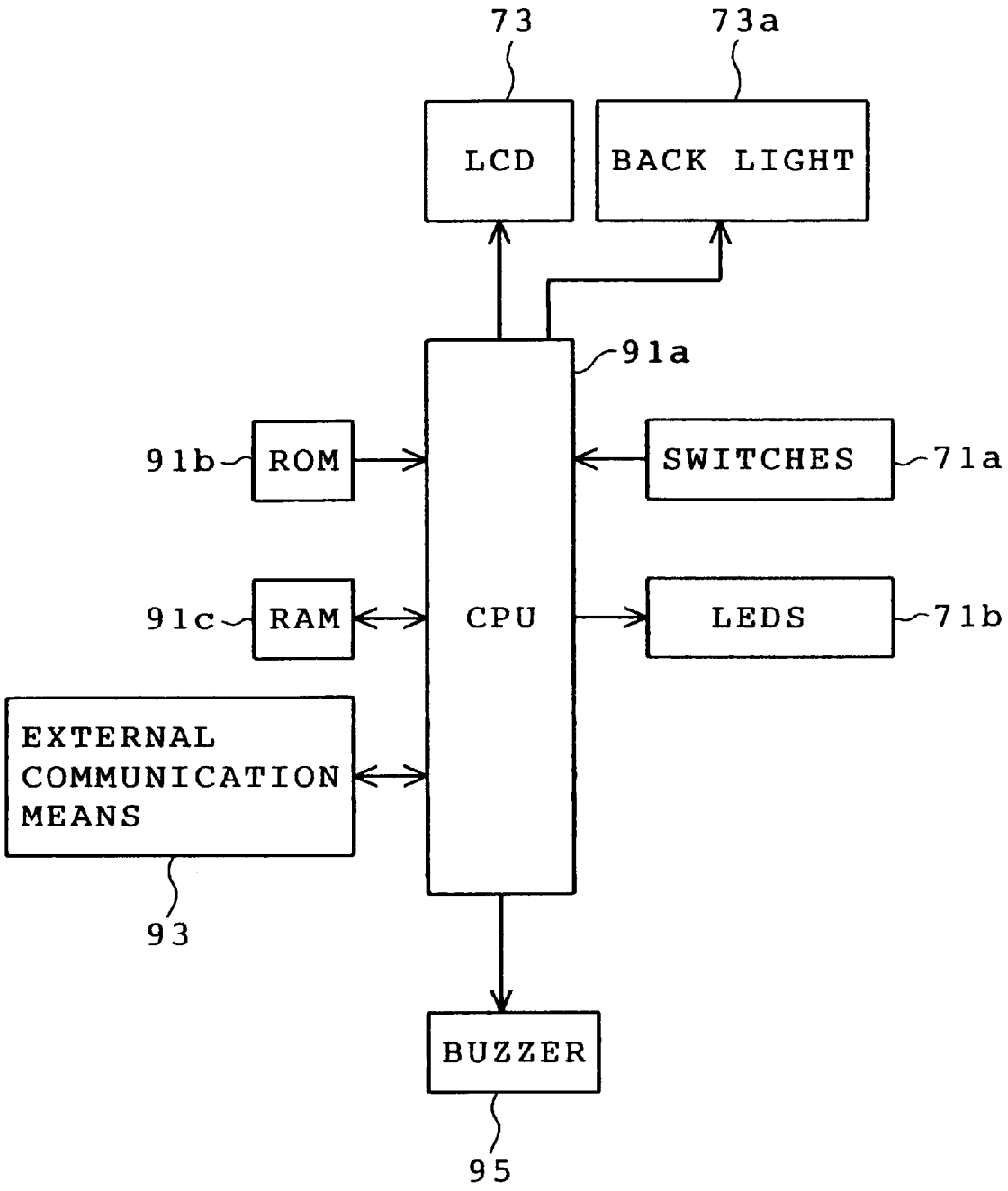
FIG. 6 is a block diagram of a control system of the programmer.

Referring now to FIG. 6, an electrical arrangement of the control system of the programmer 71 is shown. A CPU 91*a* controls the overall operation of the programmer 71 and executes various control programs stored in a ROM 91*b*. A RAM 91*c* temporally stores various data during operation of the CPU 91*a* . The CPU 91*a* delivers drive signals to the LCD 73 and a back light 73*a* of the LCD 73 to drive them. The CPU 91*a* receives switch signals from the switches 71*a* of the programmer 71 and delivers drive signals to the LEDs 71*b* provided in a part of the switches 71*a* to drive them. The CPU 91*a* further transmits and receives data to and from the sewing machine 1 etc. via the above-mentioned external communication means 93. The CPU 91*a* further delivers a drive signal to the buzzer 95 so that the buzzer performs an alarming operation.

According to the above-described programmer 71, the user operates the various switches 71*a* , viewing the icons displayed on the LCD 73, so that data is entered via the floppy disk drive 51. The sewing program can be composed on the basis of the entered data. When the user operates the start switch 27 after composition of the program, the CPU 85*a* of the sewing machine 1 controls the X-axis and Y-axis motors 21 and 23, and the sewing machine motor 41 so that a sewing operation is executed on the workpiece cloth 99 according to the composed program. The user can also compose the program using the read/write switch 53 and the program number setting switch 55 when it has relatively simple contents.

Figure 4:
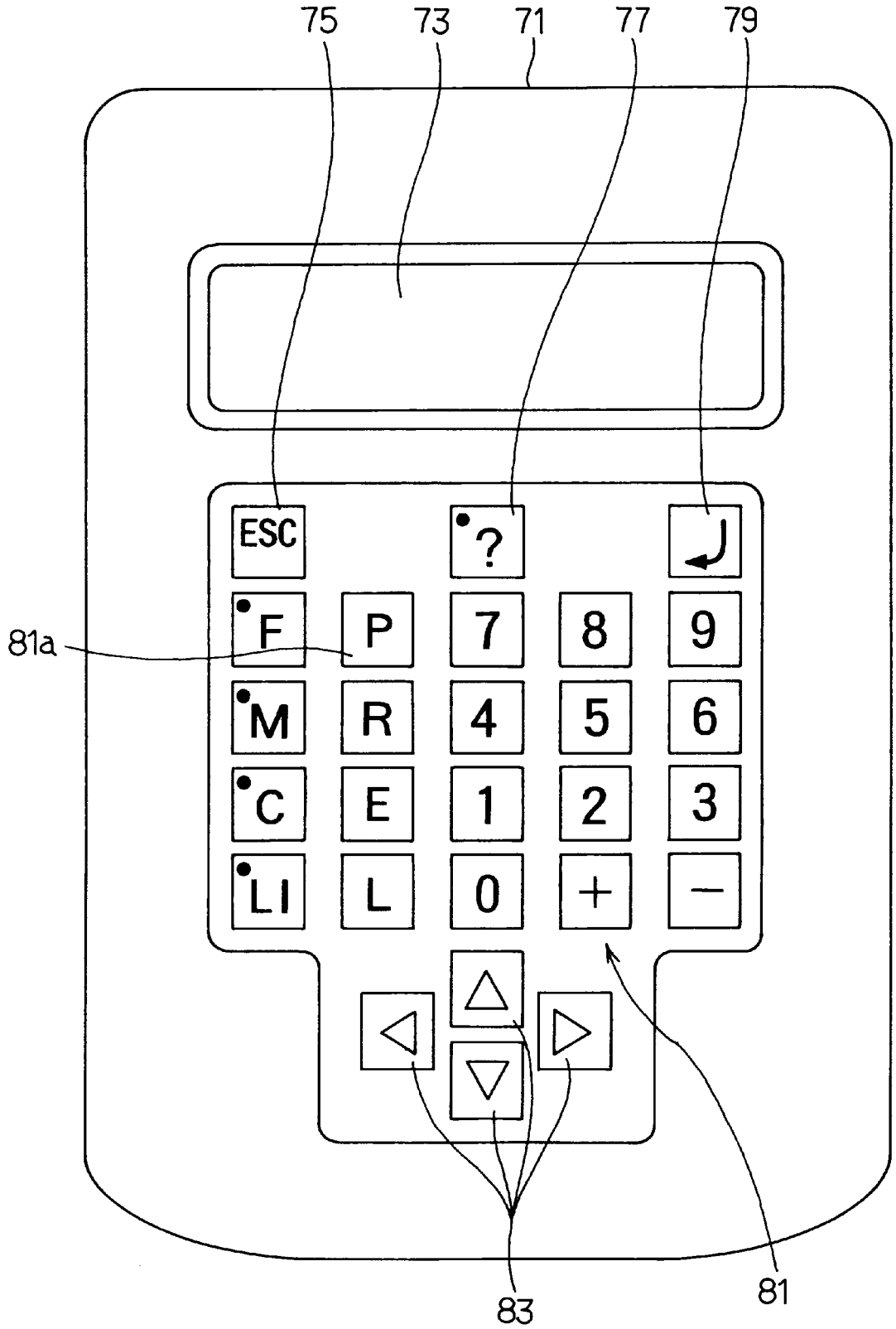
FIG. 4 is a plan view of a programmer provided for the sewing machine.
Figure 7A:
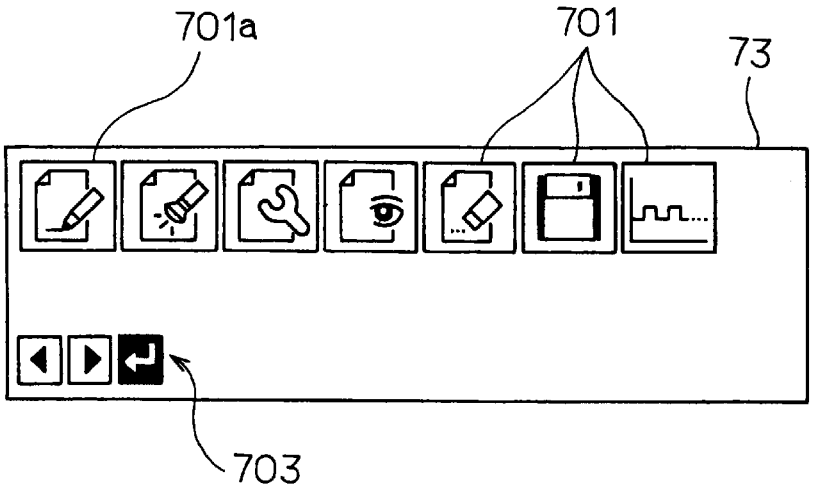
FIGS. 7A to 7C illustrate initial screens of a display of the programmer.

The composition of the sewing program by use of the programmer 71 will be described with reference to FIGS. 7A to 9C showing the examples of screens of the LCD 73 in the program composition. First, the programmer 71 is connected to the operation panel 29 of the sewing machine 1 connected to the power supply. Thereafter, when a character key 81*a* (see FIG. 4) representative of "P" is depressed, the CPU 85*a* is switched to a program composition mode, and the LCD 73 displays a main menu as shown in FIG. 7A. An initial screen of the main menu displays on its upper part seven icons 701 representative of "composition" of a subordinate menu, "tracing, " "edit," "image display," "new composition (delete)," "file operation," and "sequencer" sequentially from the left. An operable key display section 703 is displayed on the lower part of the screen. The operable key display section displays currently operable switches 71*a* of the programmer 71. In this case, arrow keys 83 rightward and leftward movement and the ENTER key 79 are displayed.

Figure 7B:
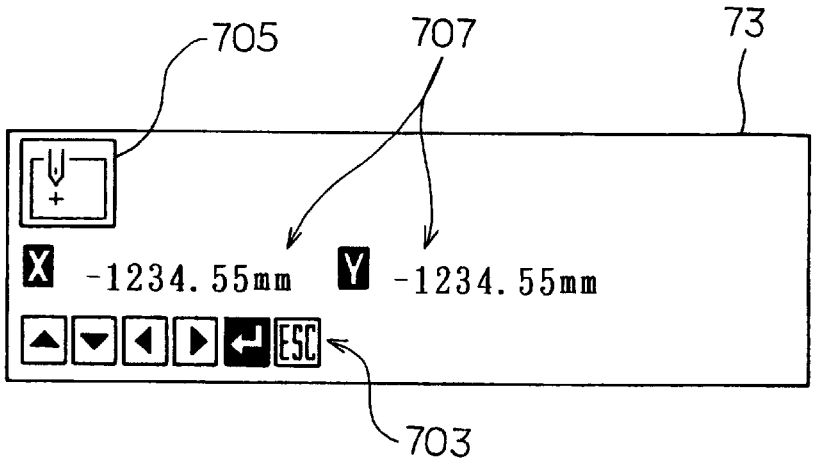

One or both of the arrow keys 83 are operated so that the icon 701*a* representative of "composition" is selected and then, the ENTER key 79 is operated. The LCD 73 then displays a menu for designating a sewing start point as shown in FIG. 7B. An icon 705 representative of the sewing start point designating screen is displayed on the left-hand upper part of the screen. The operable key display section 703 on the lower part of the screen displays four arrow keys 83, the ENTER key 79 and the ESC key 75. On the sewing start point designating screen, the user operates the arrow keys 83 so that the cloth presser 15 is actually moved in the X and Y directions or forward, rearward, leftward and rightward, thereby designating a sewing start point. More specifically, when the arrow keys 83 of the programmer 71 are operated, the cloth presser 15 is moved in the X and Y directions according to the directions represented by the operated arrow keys 83. Furthermore, a distance display section 707 on the central screen also displays X-axis and Y-axis components of the distance between a home position and a needle location or the location beneath the needle 45. When the ENTER key 79 is operated after the cloth presser 15 has been moved to a desired needle location, the needle location is set as the sewing start point, and an input method selecting menu as shown in FIG. 7C is then displayed.

The input method selecting menu screen displays 20 icons 711 representative of "straight line," "smoothing," "circle," "circular arc," "semicircular," "zigzagging circle," "zigzag," "double stitched seam," "stitch," "feed," "basting," "split," "end code," "enlarged input," "low-speed conversion," "deletion," "trigger code," "image display," "edit," and "tracing." These icons 711 are arranged sequentially in rows from the left-hand upper part of the screen. The contents of the operable key display section 703 is the same as those in FIG. 7B. Selection of the input method and input of the needle location as will be described later are repeated so that the sewing program is composed.

Figure 7C:
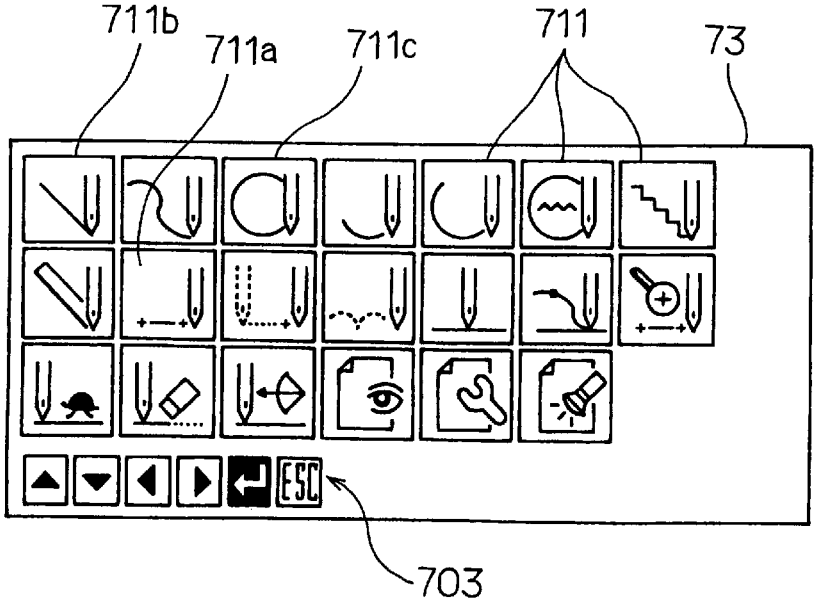
Figure 8A:
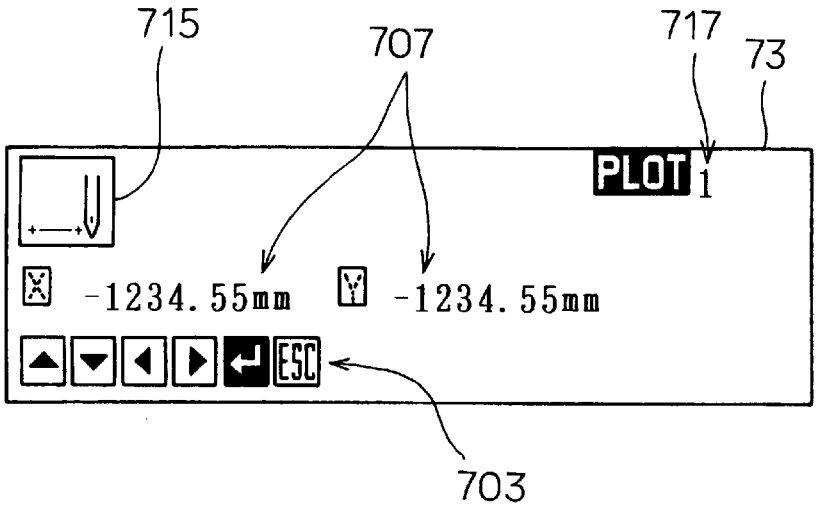
FIGS. 8A to 8C illustrate screens of the display of the programmer when a stitch and straight line are entered.

For example, when the icon 711*a* representative of "stitch" is selected in the input method selecting menu shown in FIG. 7C, a stitch forming menu as shown in FIG. 8A is displayed. An icon 715 representative of the stitch input is displayed on the left-hand upper part of the screen of the stitch forming menu. Upon operation of the arrow keys 83, the cloth presser 15 is moved and the X-axis and Y-axis components of the distance between the previous needle location and the current needle location are displayed on the distance display section 707. Furthermore, a remaining plot number 717 to be entered in the menu is displayed on the right-hand upper part of the screen. When the ENTER key 79 is operated after the cloth presser 15 has been moved to a desired needle location, the needle location is set as the next needle location. The screen of the LCD 73 returns to the above-described input method selecting menu when the ESC key 75 has been operated.

Figure 8B:
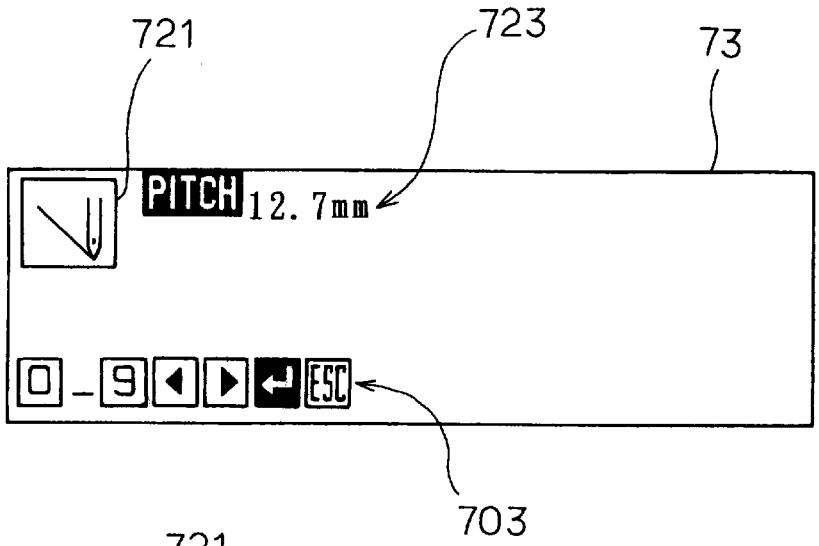
Figure 8C:
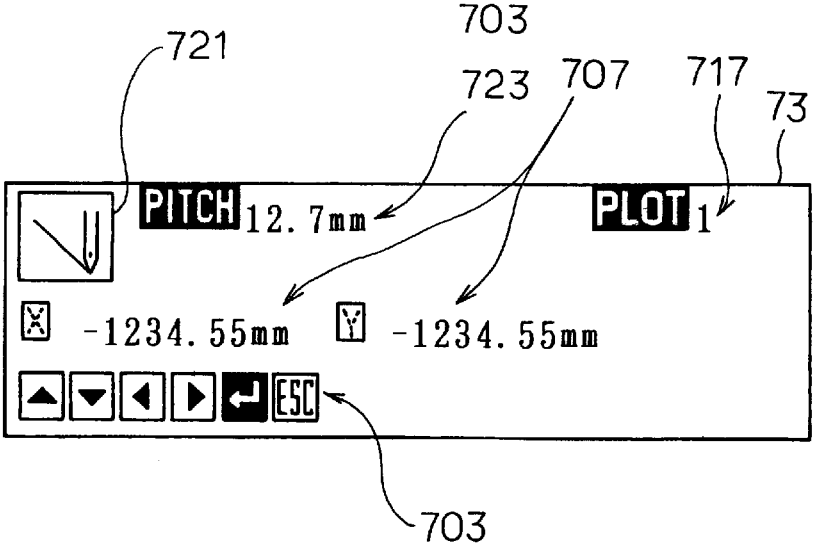

Upon selection of an icon 711*b* representative of "straight line" in the input method selecting menu of FIG. 7C, a straight pitch designating menu as shown in FIG. 8B is displayed. In this menu, the icon 721 representative of the input of straight line is displayed on the left-hand upper part of the screen. In this menu screen, the character keys 81 representative of the numerals 0 to 9 can be operated as shown in the operable key display section 703. The pitch for the straight stitch is then designated by a numeral so that the pitch is displayed in a pitch display section 723 on an upper part of the screen. When the ENTER key 79 is then operated, the straight pitch is designated and a straight plot menu as shown in FIG. 8C is displayed.

On the straight plot menu, an end point of the straight line can be set by the arrow keys 83. In this case, too, the distance between the previous and current points is displayed in the distance display section of the screen. When the ESC key 75 is operated once, the screen returns to the previous straight pitch designating menu. When the ESC key 75 is further operated, the screen returns to the input method selecting menu.

Figure 9A:
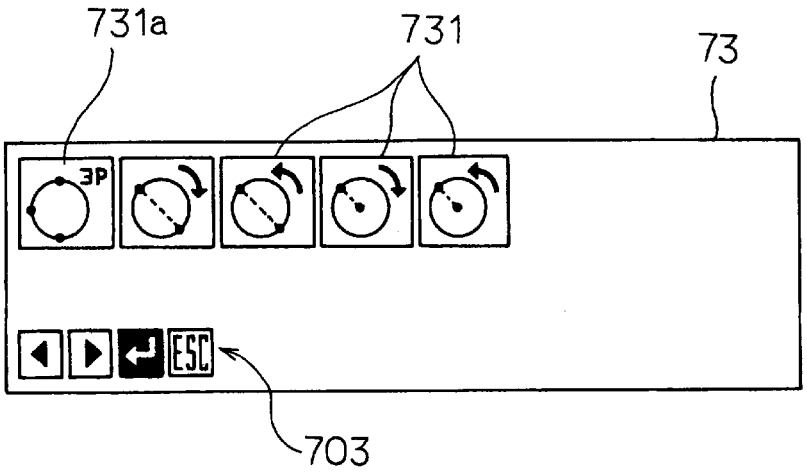
FIGS. 9A to 9C illustrate screens of the display of the programmer when the figure of a circle is entered.
Figure 9B:
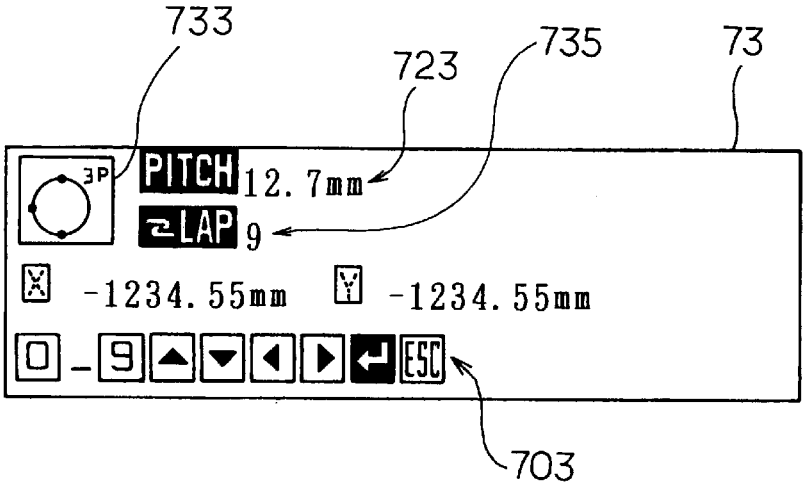

Upon selection of an icon 711*c* representative of "circular" in the input method selecting menu of FIG. 7C, a circle forming method selecting menu as shown in FIG. 9A is displayed. This menu screen includes five icons 31 representative of "three-point designated circle," "diameter designated clockwise circle," "diameter designated counterclockwise circle," "radius designated clockwise circle," and "radius designated counterclockwise circle" as the kinds of the circle forming methods. When an icon 731*a* representative of "three-point designated circle" is selected, a screen of a circle designating menu as shown in FIG. 9B is displayed.

Figure 9C:
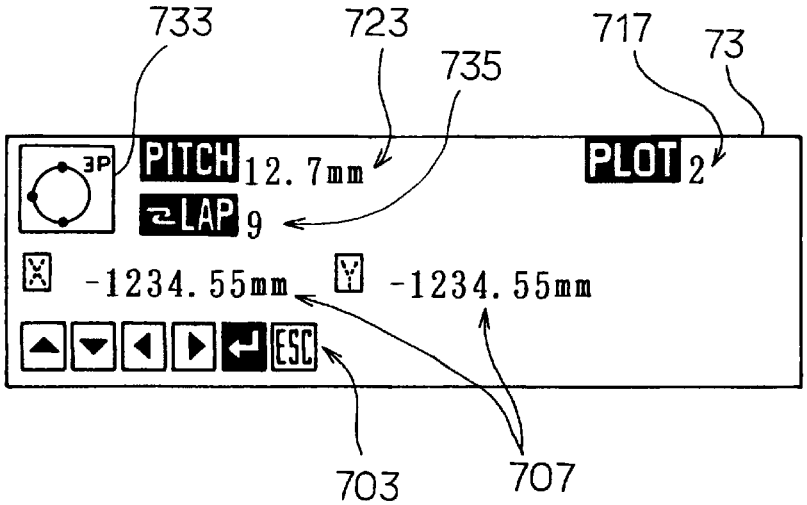

On the circle designating menu screen, an icon 733 representative of the three-point designated circle is displayed at the left-hand upper part of the screen. The pitch and the number of lapped seams at the sewing end can be designated by the character keys 81 representative of the numerals 0 to 9. The designated pitch and lapped seam number are displayed in a pitch display section 723 and a lap display section 735 respectively. When the ENTER key 79 is operated so that these numerals are set, a circle plot menu as shown in FIG. 9C is displayed on the screen. On this circle plot menu screen, the arrow keys 83 are operated so that three points defining the circle are set. Thereafter, when the ESC key 75 is operated, the screen returns sequentially to the circle designating menu, the circle forming method selecting menu, and the input method selecting menu.

According to the above-described embodiment, the screen of the LCD 73 of the programmer 71 displays the various commands used in the composition of the program in the form of the icons 701 to 731. Consequently, even the beginner can readily select the icons corresponding to the desired commands. The icons corresponding to the desired commands and the ENTER key 79 are selected. Then, when the data concerning the pitch etc. is entered by the character keys 81, the desired program can readily be composed. Thus, when the programmer 71 is used, even the beginner can readily compose the program. Furthermore, the icons 701 to 731 are displayed as corresponding to the various commands. New icons can be added when new functions are added. Since no keys or the like are necessary, the version-up of the software can readily be coped with and accordingly, the substantial cost of the sewing machine can be reduced.

The operable key display section 703 is displayed in the lower part of the screen of the LCD 73 in the foregoing embodiment. The user can quickly learn the currently operable switches 71*a* on the basis of the displayed contents of the operable key display section 703. This prevents the user from erroneous operation of the switches 71*a* and from hesitating as to which switch 71*a* should be operated. Consequently, the program can further readily be composed.

The programmer 71 is portable and can disconnectably be connected to the operation panel 29 of the sewing machine 1 in the foregoing embodiment. The programmer 71 can be connected to the sewing machine 1 only when the program is composed. Otherwise, the programmer 71 can be disconnected from the sewing machine 1. Furthermore, the programmer 71 can be carried to the sewing machine 1 for which the program is to be composed and can be connected to the sewing machine 1 so that the program composing work can be executed readily and quickly. Consequently, the single programmer 71 can be used in common to several sewing machines 1. Sewing facilities such as sewing factories are generally equipped with a plurality of, for example, more than ten, sewing machines. However, the programs do not almost need to be composed simultaneously for all the sewing machines. Even if the programs need to be composed for a plurality of sewing machines, the operator usually composes the programs one by one. Moreover, the programmer 71 can readily be carried as described above. Accordingly, even when the single programmer 71 is used in common to several sewing machines, the programmer does not interfere with the sewing work or reduce the working efficiency. Consequently, the equipment cost of the facility can be restrained and the substantial cost of the programmer 71 can be reduced.

The program composing processes on the basis of the data supplied from the programmer 71 may be executed either in the programmer 71 or in the sewing machine 1. When the program composing processes are executed in the programmer 71, the composed program may be transmitted to the sewing machine 1. Thus, the sewing machine 1 or the programmer 71 constitutes program composing means in the invention.

The programmer 71 displays the error contents as well as serves as the program composing means in the foregoing embodiment. However, the programmer may be dedicated to the program composition or may be constituted together with other devices. In the foregoing embodiment, a further cost reduction is attained since the programmer 71 serves as two devices.

Although the cloth presser 15 is moved in the X and Y directions in the foregoing embodiment, the cloth presser may be moved in an R-θ direction in the polar coordinates. Furthermore, the programmer 71 is detachably connected to the sewing machine 1 so as to be used in common to several sewing machines 1 in the foregoing embodiment. However, the programmers may be fixed to the respective sewing machines 1, instead. Furthermore, the single programmer may usually be connected to a plurality of sewing machines. The former case results in a cost increase, and the latter case cannot cope with the production of a large number of types of products in a small quantity since the sewing machines cannot execute different programs.

The forms of the icons may be varied. For example, although only the picture patterns corresponding to the respective commands are displayed as almost all the icons in the foregoing embodiment, a sentence and the picture pattern each corresponding to the respective commands may be simultaneously displayed as all the icons. In this case, each icon has a more definite meaning and can accordingly transmit its meaning more correctly regardless of the sensitivity of the user. As a result, the program can further readily be composed.

Although the programmer 71 is operated for composition of the program in the foregoing embodiment, the operation panel 29 may be operated for the same purpose, instead. More specifically, a display may be provided on the operation panel 29 to serve as displaying means for displaying the icons, and the keys of the operation panel may serve as the input means in the invention. The same effect can be achieved in this constitution as in the foregoing embodiment. Additionally, an operation panel may be provided on a side of the arm or the bed of the sewing machine body, and the displaying means and the input means in the invention may be provided in the operation panel.

Various control programs for operating the sewing machine 1 and the programmer 71 are recorded both in the ROM 85*b* of the control system and in the ROM 91*b* of the control system of the programmer 71 in the foregoing embodiment. However, the sewing machine 1 or the programmer 71 may be provided with a reader for reading each program stored in the flexible disk, the CDROM or the IC card, so that the program is entered into the sewing machine 1 via the recording medium. In this arrangement, a flush memory or hard disk system is preferably provided in the sewing machine 1 or the programmer 71.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

We claim:

1. A programmable electronic sewing machine comprising:

sewing means for executing a sewing operation according to a predetermined program;

program composing means for composing the program;

displaying means for displaying display contents variable at a first position, the display contents including a plurality of icons representative of commands used in composition of the program respectively; and input means for entering data used in composition of the program and for selecting a desired one of the icons displayed by the displaying means.

2. A sewing machine according to claim 1, wherein the displaying means displays, together with the icons, an operating manner of the input means allowed with respect to the displayed icons.

3. A sewing machine according to claim 1, which further comprises a portable operation panel connected to and disconnected from the sewing machine, and wherein the displaying means and the input means are provided on the operation panel.

4. A sewing machine according to claim 2, which further comprises a portable operation panel connected to and disconnected from the sewing machine, and wherein the displaying means and the input means are provided on the operation panel.

5. A sewing machine according to claim 1, which further comprises an operation panel, and wherein the displaying means and the input means are provided on the operation panel.

6. A sewing machine according to claim 2, which further comprises an operation panel, and wherein the displaying means and the input means are provided on the operation panel.

7. A programmable electronic sewing machine comprising:

a sewing device for executing a sewing operation according to a predetermined program;

a program composing device for composing a sewing program;

a displaying device for displaying display contents variable at a first position, the display contents including a plurality of icons representative of commands used in composition of the program respectively; and an input device for entering data used in composition of the program and for selecting a desired one of the icons displayed by the displaying device.

8. A sewing machine according to claim 7, wherein the displaying device displays, together with the icons, an operating manner of the input device allowed with respect to the displayed icons.

9. A sewing machine according to claim 7, which further comprises a portable operation panel connected to and disconnected from the sewing machine, and wherein the displaying device and the input device are provided on the operation panel.

10. A sewing machine according to claim 8, which further comprises a portable operation panel connected to and disconnected from the sewing machine, and wherein the displaying device and the input device are provided on the operation panel.

11. A sewing machine according to claim 7, which further comprises an operation panel, and wherein the displaying device and the input device are provided on the operation panel.

12. A sewing machine according to claim 8, which further comprises an operation panel, and wherein the displaying device and the input device are provided on the operation panel.

13. A recording medium for recording a control program for operating a programmable electronic sewing machine, the control program accomplishing the functions of:

sewing means for executing a sewing operation according to a predetermined program;

program composing means for composing a sewing program;

displaying means for displaying display contents variable at a first position, the display contents including a plurality of icons representative of commands used in composition of the sewing program respectively; and input means for entering data used in composition of the sewing program and for selecting a desired one of the icons displayed by the displaying means.

14. A recording medium according to claim 13, wherein the displaying means displays, together with the icons, an operating manner of the input means allowed with respect to the displayed icons.

15. A recording medium according to claim 13, wherein the sewing machine comprises a portable operation panel connected thereto and disconnected therefrom, and wherein the displaying means and the input means are provided on the operation panel.

16. A recording medium according to claim 14, wherein the sewing machine comprises a portable operation panel connected to and disconnected from the sewing machine, and wherein the displaying means and the input means are provided on the operation panel.

17. A recording medium according to claim 13, wherein the sewing machine comprises an operation panel, and wherein the displaying means and the input means are provided on the operation panel.

18. A recording medium according to claim 14, wherein the sewing machine comprises an operation panel, and wherein the displaying means and the input means are provided on the operation panel.

19. A sewing machine according to claim 1, wherein the displaying means comprises an LCD.

20. A sewing machine according to claim 7, wherein the displaying device comprises an LCD.

* * * * *